US007722437B2

(12) United States Patent
Ito

(10) Patent No.: US 7,722,437 B2
(45) Date of Patent: May 25, 2010

(54) MANUFACTURING METHOD OF SEMICONDUCTOR INTEGRATED CIRCUIT DEVICE

(75) Inventor: Yoshinori Ito, Tokyo (JP)

(73) Assignee: Renesas Technology Corp., Tokyo (JP)

( * ) Notice: Subject to any disclaimer, the term of this patent is extended or adjusted under 35 U.S.C. 154(b) by 0 days.

(21) Appl. No.: 12/116,958

(22) Filed: May 8, 2008

(65) Prior Publication Data

US 2008/0305715 A1 Dec. 11, 2008

(30) Foreign Application Priority Data

Jun. 6, 2007 (JP) ..... 2007-149901

(51) Int. Cl.
*B24B 49/00* (2006.01)
*B24B 51/00* (2006.01)

(52) U.S. Cl. ..... 451/9; 451/21; 451/36; 451/41; 451/56; 451/63; 451/72; 451/443

(58) Field of Classification Search ..... 156/345.12, 156/345.13; 438/633, 690, 691, 692; 451/8, 451/9, 21, 22, 36, 41, 54, 56, 59, 63, 72, 451/443

See application file for complete search history.

(56) References Cited

U.S. PATENT DOCUMENTS 5,934,974 A 8/1999 Tzeng
6,040,244 A 3/2000 Arai et al.
6,322,434 B1 * 11/2001 Satoh et al. ..... 451/443
6,609,962 B1 * 8/2003 Wakabayashi et al. ..... 451/443
6,835,116 B2 * 12/2004 Oguri et al. ..... 451/8
7,070,479 B2 * 7/2006 Faustmann et al. ..... 451/21
2002/0160609 A1 * 10/2002 Katagiri et al. ..... 438/692
2008/0070479 A1 * 3/2008 Nabeya et al. ..... 451/8
2008/0090499 A1 * 4/2008 Fujita ..... 451/56

FOREIGN PATENT DOCUMENTS

JP 9-290363 A 11/1997
JP 10-86056 A 4/1998
JP 11-207572 A 8/1999
JP 2000-271854 A 10/2000
JP 2001-79752 A 3/2001

* cited by examiner

*Primary Examiner*—Timothy V Eley
(74) *Attorney, Agent, or Firm*—Miles & Stockbridge P.C.

(57) ABSTRACT

A polishing pad used in a CMP step in the manufacture of a semiconductor integrated circuit device is relatively expensive; thus, it is necessary to avoid a wasteful exchange of the pad. Accordingly, it is important to measure the abrasion amount of this pad precisely. However, in ordinary measurement thereof through light, the presence of a slurry hinders the measurement. In measurement thereof with a contact type sensor, a problem that pollutants elute out is caused. In a CMP step in the invention, the height position of a dresser is measured while the dresser operates, thereby detecting the abrasion amount or the thickness of a polishing pad indirectly. In this way, the time for exchanging the polishing pad is made appropriate.

18 Claims, 13 Drawing Sheets

MANUFACTURING METHOD OF SEMICONDUCTOR INTEGRATED CIRCUIT DEVICE

BACKGROUND OF THE INVENTION

The present invention relates to a technique useful for chemical mechanical polishing technique, which is generally called CMP technique, in a manufacturing method of a semiconductor integrated circuit device (or a semiconductor device).

Japanese Unexamined Patent Publication No. 2000-271854 discloses a technique of measuring the flatness, the surface roughness, the elastic modulus, the porosity and other properties of a polishing pad of a CMP machine to use the measured properties to decide the time when the pad is exchanged, or the like.

Japanese Unexamined Patent Publication No. Hei 11 (1999)-207572 or corresponding U.S. Pat. No. 5,934,974 discloses a system of monitoring the abrasion of a polishing pad of a CMP machine with a noncontact sensor while the machine operates, so as to instruct the exchange of the pad, or the like.

Japanese Unexamined Patent Publication No. Hei 9 (1997)-290363 discloses a method of measuring the height of a polishing pad of a CMP machine, thereby deciding the exchange of the pad.

Japanese Unexamined Patent Publication No. 2001-079752 discloses a technique of setting an optical sensor and other sensors to a dresser mechanism of a CMP machine to measure the thickness of a polishing pad, and then adjusting the dressing amount on the basis thereon.

Japanese Unexamined Patent Publication No. Hei 10 (1998)-086056 or corresponding U.S. Pat. No. 6,040,244 discloses a system of instructing the time of the exchange of a polishing pad from measurement results of the thickness of the polishing pad before and after a CMP machine performs CMP work.

SUMMARY OF THE INVENTION

In the CMP step in the manufacture of semiconductor integrated circuit devices, it is necessary to dress a polishing pad always or intermittently. By this dressing treatment and polishing, the polishing pad is worn away. Thus, it is indispensable to exchange the pad periodically or in accordance with the amount of the processing based on the pad. However, the polishing pad is relatively high in price, and it is necessary to avoid exchanging the pad wastefully. Accordingly, it is important to measure the abrasion amount of the pad precisely. However, according to ordinary measurement thereof through light, the presence of slurry hinders the precise measurement. According to a contact type sensor, a problem arises due to pollutants.

An object of the present invention is to provide a manufacturing method of a semiconductor integrated circuit device which is suitable for mass production.

The object of the invention, other objects thereof, and new features thereof will be evident from the present specification and attached drawings.

A typical aspect of the invention disclosed in the present application will be briefly described in the following:

The typical aspect of the invention is a method in which when a dresser operates in a CMP step, the height position of the dresser is measured, thereby detecting the abrasion amount or the thickness of a polishing pad indirectly.

Advantageous effects of the typical aspect of the invention disclosed in the present application will be briefly described in the following:

When the dresser operates, the height position of the dresser is measured, thereby detecting the abrasion amount or the thickness of the polishing pad indirectly; therefore, the physical quantity can be measured without polluting the polishing pad with a sensor or any other member.

BEST MODE FOR CARRYING OUT THE INVENTION

Summary of Embodiments

Figure 1:
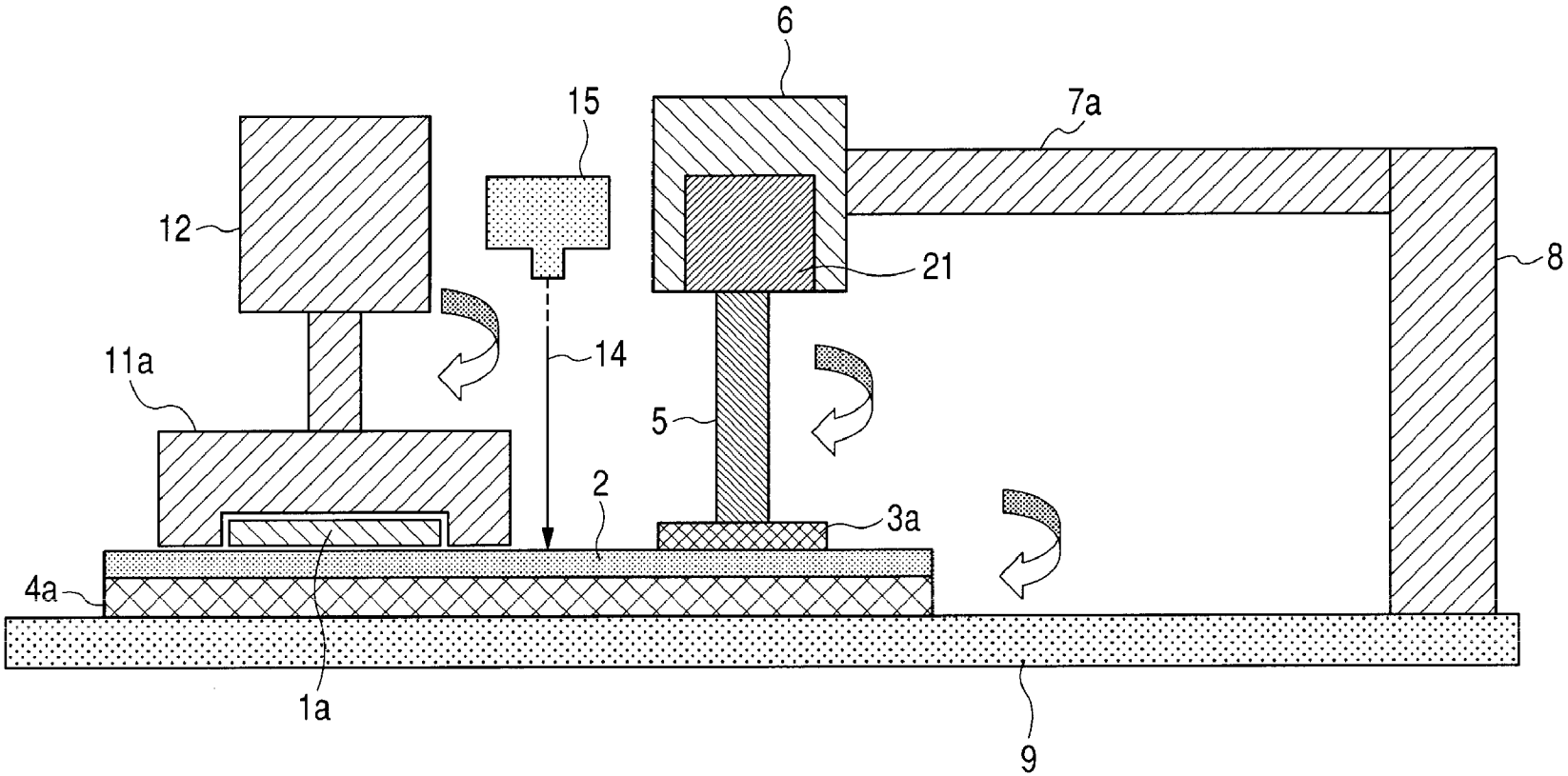
FIG. 1 is a schematic side view of a CMP machine used in a semiconductor integrated circuit device manufacturing method of an embodiment of the invention.

First, typical embodiments of the invention disclosed in the present application will be summarized in the following:

1. A manufacturing method of a semiconductor integrated circuit device, comprising the steps of: (a) forming a first member layer over a first main surface of a wafer; and (b) applying chemical mechanical polishing to the first member layer in a chemical mechanical polishing machine, wherein the step (b) comprises the substeps of: (i) pressing a rotating dresser to a polishing pad, thereby carrying out dressing treatment; (ii) supplying a polishing slurry to the polishing pad while moving the pad and the wafer relatively in a state that the first main surface of the wafer is pressed to the polishing pad; and (iii) measuring the position of the dresser in the direction perpendicular to the surface of the polishing pad in the substep (i), thereby detecting the abrasion amount and the thickness of the polishing pad indirectly.
2. The manufacturing method of a semiconductor integrated circuit device according to item 1, wherein at least one portion of a first term when the substep (i) is performed and at least one portion of a second term when the substep (ii) is performed overlap with each other.
3. The manufacturing method of a semiconductor integrated circuit device according to item 1 or item 2, wherein the first member layer is an insulation layer.
4. The manufacturing method of a semiconductor integrated circuit device according to any one of item 1 to item 3, wherein the first member layer comprises a silicon oxide film as a principal constituent film.
5. The manufacturing method of a semiconductor integrated circuit device according to any one of item 1 to item 4, wherein about the first term when the substep (i) is performed and the second term when the substep (ii) is performed, main portions thereof overlap with each other.
6. The manufacturing method of a semiconductor integrated circuit device according to any one of item 1 to item 5, wherein the perpendicular position is measured without bringing a sensor into direct contact with the polishing pad.
7. The manufacturing method of a semiconductor integrated circuit device according to any one of item 1 to item 6, wherein the perpendicular position is measured without using light.
8. The manufacturing method of a semiconductor integrated circuit device according to any one of item 1 to item 7, wherein the polishing pad is rotating in the substeps (i) and (ii).
9. The manufacturing method of a semiconductor integrated circuit device according to item 8, wherein the wafer is rotating in the substep (ii).
10. The manufacturing method of a semiconductor integrated circuit device according to any one of item 1 to item 9, wherein about the dresser, the position thereof in the direction of the radius of the polishing pad is varied over the polishing pad in the substep (i).
11. The manufacturing method of a semiconductor integrated circuit device according to any one of item 1 to item 10, wherein the perpendicular position is measured plural times in the first term when the substep (i) is performed.
12. The manufacturing method of a semiconductor integrated circuit device according to any one of item 1 to item 11, wherein the dresser is fixed to a dresser holding rotary section, the dresser holding rotary section can be controlled to be stretched and shrunken up and down, the rotary section itself is rotatably held by a dresser head section, the dresser head section is held by a dresser supporting section through a dresser arm, and the dresser supporting section is held by a base of the chemical mechanical polishing machine so as to be optionally rotated on its axis of the section.
13. The manufacturing method of a semiconductor integrated circuit device according to any one of item 1 to item 12, wherein the perpendicular position is measured through a displacement sensor comprising a sensor body comprising a coil section, and a displacement body.
14. The manufacturing method of a semiconductor integrated circuit device according to item 13, wherein the sensor body is fitted to the dresser head section, which holds the dresser.
15. The manufacturing method of a semiconductor integrated circuit device according to item 13 or item 14, wherein the displacement body is fixed to the dresser holding rotary section.
16. The manufacturing method of a semiconductor integrated circuit device according to any one of item 13 to item 15, wherein the displacement sensor is a sensor for measuring, electrically, a change in the impedance of the coil section in the displacement sensor on the basis of a displacement of an object to be measured.
17. The manufacturing method of a semiconductor integrated circuit device according to any one of item 1 to item 11, wherein the dresser is fixed to a dresser holding rotary section, the dresser holding rotary section is rotatably held by a dresser head section, the dresser head section is held by a dresser supporting section through a dresser arm, and the dresser supporting section is held by a base of the chemical mechanical polishing machine so as to be optionally moved up and down and rotated on its axis of the section.
18. The manufacturing method of a semiconductor integrated circuit device according to item 17, wherein the perpendicular position is measured through a displacement sensor comprising a sensor body comprising a coil section, and a displacement body.
19. The manufacturing method of a semiconductor integrated circuit device according to item 18, wherein the displacement sensor is fitted to the dresser supporting section.
20. The manufacturing method of a semiconductor integrated circuit device according to item 18 or item 19, wherein the perpendicular position is measured by measuring the up-and-down motion of the dresser supporting section through the displacement sensor.

The following will describe other embodiments of the invention disclosed in the present application.

21. A manufacturing method of a semiconductor integrated circuit device, comprising the steps of: (a) forming a first member layer over a first main surface of a wafer; and (b) applying chemical mechanical polishing to the first member layer in a chemical mechanical polishing machine, wherein the step (b) comprises the substeps of: (i) pressing a rotating dresser to a polishing pad, thereby carrying out dressing treatment; (ii) supplying a polishing slurry to the polishing pad while moving the pad and the wafer relatively in a state that the first main surface of the wafer is pressed to the polishing pad; and (iii) measuring the position of the dresser in the direction perpendicular to the surface of the polishing pad in the substep (i), thereby detecting the abrasion amount and the thickness of the polishing pad indirectly.

Explanation of the Description Manner, Basic Terms, and Format in the Present Application 1. In the present application, for the sake of convenience, any embodiment may be divided into plural sections as the case may be, so as to be described in accordance with the sections. However, these are not independently of each other; thus, these may be individual sections of a single example, or one thereof may be details of a part of the other(s) or may be a modification of a part or the whole of the other(s) except any case where it is evidently stated that such a matter is not applicable to the case. In principle, about the same members or portions, repeated description is omitted. Each of constituting elements in any embodiment is not essential except any case where it is evidently stated that this matter is not applicable to the case, any case to this matter is theoretically not applicable, and any case to which this matter is clearly interpreted not to be applicable from the context.
2. In connection with any material, any composition or the like in the description of embodiments and others, in the case of using the wording "X made of A" or the like, a matter that an element other than A is contained as a principal constituting element is excluded except any case where it is evidently stated that this matter is not applicable to the case, any case to this matter is theoretically not applicable, and any case to which this matter is clearly interpreted not to be applicable from the context in the same manner as described above. For example, the wording "X made of A" means that "X contains A as a principal component". It is heedless to say that, for example, the wording "silicon member" is not limited to a member comprised of pure silicon, and includes, in the category thereof, a member containing SiGe alloy or some other multi-component alloy containing silicon as a principal component, and a member containing not only Si but also other additives. In the same manner, it is needless to say that the wording "silicon oxide film" include, in the category thereof, an undoped silicon dioxide film, which is relatively pure, a FSG (fluorosilicate glass) film, a TEOS-based silicone oxide film, a SiOC (silicon oxycarbide) film, a carbon-doped silicon oxide film, thermal oxide films such as ODG (organosilicate glass), PSG (phosphorous silicate glass) and BPSG (borophosphosilicate glass) films, a CVD oxide film, painted silicon oxide films such as SOG (spin on glass) and NSC (nano-clustering silica) films, a silica-based low-k insulated film (porous insulated film), wherein pores are incorporated into any one of the same films as described above, and a composite film containing any one of the above-mentioned films, as a principal element, which is combined with a different silicon-based insulated film (silica-based insulated film).
3. In the same manner, about some figures, positions, attributes, and others, preferred examples will be described. However, it is needless to say that the figures and so on are not strictly limited to the preferred examples except any case where it is evidently stated that this matter is not applicable to the case, and any case to which this matter is clearly interpreted not to be applicable from the context.
4. When a specific numerical value or quantity is referred to, numerical values or quantities over or below the numerical value or quantity are allowable except any case where it is evidently stated that this matter is not applicable to the case, any case to this matter is theoretically not applicable, and any case to which this matter is clearly interpreted not to be applicable from the context.
5. The wording "wafer" usually denotes a monocrystal silicon wafer, on which a semiconductor integrated circuit device, which may be called a semiconductor device or an electron device, is to be formed. However, it is needless to say that the wording includes, in the category thereof, an epitaxial wafer, and a composite wafer containing an insulated substrate plus a semiconductor layer or the like.

Details of the Embodiments

The embodiments will be described in more detail. In the individual figures, to the same members or portions or to members or portions similar to each other will be attached the same or similar symbols or reference numbers. The same or similar description will be repeated.

Figure 2:
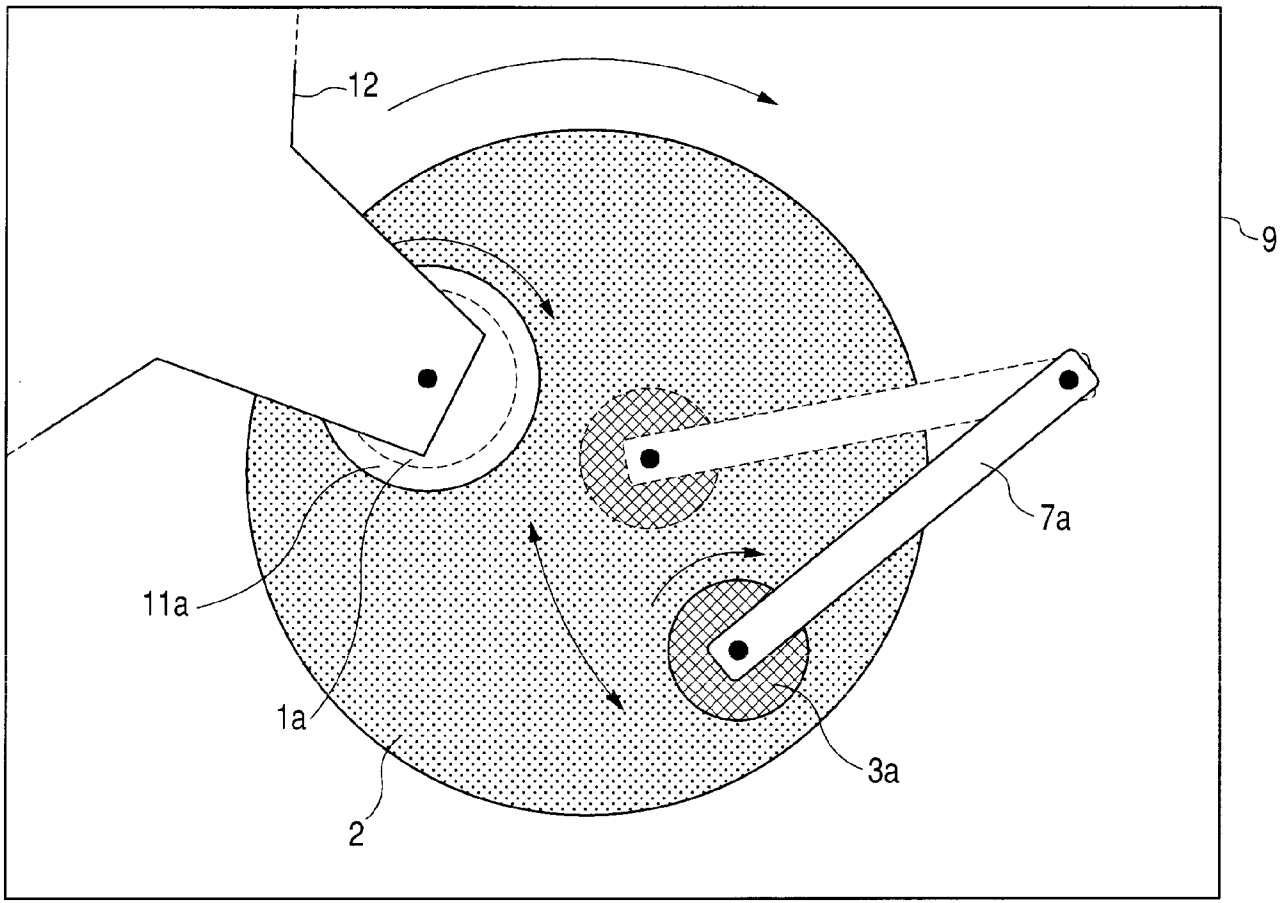
FIG. 2 is a top view of one of the platens in a CMP machine used in the semiconductor integrated circuit device manufacturing method of an embodiment of the invention, and a peripheral portion of the platen.
Figure 3:
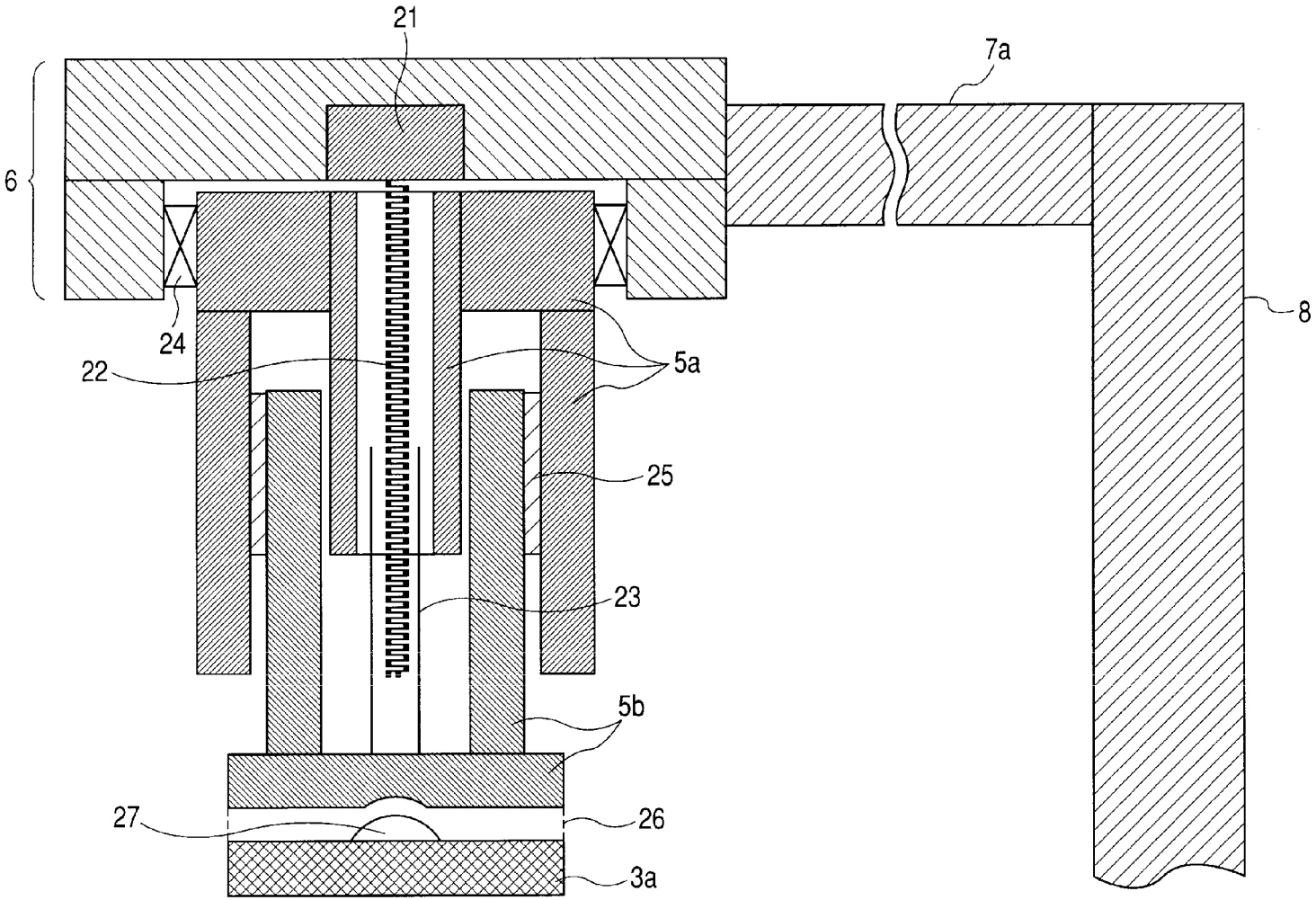
FIG. 3 is a schematic side view of a dresser mechanism in the CMP machine used in the semiconductor integrated circuit device manufacturing method of the embodiment of the invention.

With reference to FIGS. 1 to 3, the following will give an outline of the structure and the operation of a main portion of a CMP machine used in a manufacturing method of a semiconductor integrated circuit device of an embodiment of the present invention. Hereinafter, a first platen 4*a* will be mainly described. The description can be basically applied, as it is, to any other platen; thus, about the same or similar members or portions in the platens, repeated description will not be made.

FIG. 1 illustrates a situation that CMP treatment of a wafer la and dressing treatment of a polishing pad 2 are simultaneously conducted (in the embodiment, a wafer having a diameter of 300 mm is used as an example of the wafer 1*a*). In a state that a first main surface of the wafer 1*a* is pressed onto the polishing pad 2 on the first platen 4*a*, which is rotating, on a base stand 9 of the CMP machine, the polishing pad is rotated by an autorotating/revolving mechanism 12. At this time, a polishing slurry 14 is supplied from a slurry supplying section 15. A rotatable dresser 3*a* is held by a dresser holding rotary section 5 which can be stretched and shrunken up and down. This dresser holding rotary section 5 is coupled to a dresser head section 6 so as to be rotatable. This dresser head section 6 is fixed to a supporting pole 8, which can be rotated on its axis, through an arm 7*a*. This supporting pole 8 is rotatably fixed to the base stand 9. To this dresser head section 6 is fitted a displacement sensor body having a sensor head 21 and a detecting coil 22. The sensor body is combined with a displacement body (metallic pipe) 23 (see FIG. 3) fitted to the dresser side of the dresser holding rotary section 5 to form a displacement sensor.

FIG. 2 is a top view illustrating the situation that the CMP treatment of the wafer 1*a* and the dressing treatment of the polishing pad 2 are simultaneously conducted. During the dressing treatment, the dresser 3*a* is rotated on its axis and further the dresser 3*a* is repeatedly swung as shown by a broken line. On the basis of a relationship between the swinging and the rotation of the polishing pad 2, the dresser 3*a* passes over almost all of points at which the wafer actually contacts on the polishing pad 2. The rotational speed of each of the platens is, for exampie, 63rpm, the rotational speed of the dresser (the dresser diameter: for example, about 10 cm) is 90 rpm, the dressing load is 7 lbf (about 3 kgw), the swing speed, which is also called the sweep frequency, is 19 times/minute (one reciprocation corresponds to one time), and the swing width of the center of the dresser is 43 cm. The diameter of the wafer 1*a*is smaller than that of the dresser 3*a* in this manner; thus, in this case, the controllability of the dressing becomes better than in the case of using a dresser having a larger diameter. The dresser that be used is, for example, a dresser as used in this embodiment, wherein dressing particles, such as diamond grains, are embedded in a substantially entire surface of a disc, a dresser wherein the same processing is applied to a substrate in a ring form, or a dresser wherein plural dresser plates in the form of segments are fixed, into a ring form, to the circumference of a disc. The diameter of the dresser referred to in the present application is substantially equal to the diameter of the disc, the substrate, or any other base plate or substrate.

FIG. 3 is an enlarged view illustrating the dresser head section 6 of the dresser mechanism, and a portion of the mechanism positioned ahead of the head section 6. With reference to FIG. 3, details of the dresser mechanism are described as follows. To the center of the dresser head section 6 is fixed the sensor head 21, and the coil 22 is projected from the lower plane of this sensor head 21. About the displacement body 23, its lower end is fixed to a lower structure 5*b* of the dresser holding rotary section 5, and a part of the coil 22 is inserted into the displacement body 23. This lower structure 5*b* of the dresser holding rotary section 5 is coupled to an upper structure 5*a* through an up-and-down sliding section 25 in such a manner that the lower structure 5*b* can be slid up and down and can transmit rotation. The upper structure 5*a* is rotatably coupled to the dresser head 6 through a bearing 24. The dresser (dressing plate or conditioner plate) 3*a* is coupled to the lower end of the lower structure 5*b* through a flexible connector 26 which can transmit rotation and freely swings up and down. The lower end of the lower structure 5*b* and the dresser 3*a* follow the pad surface by action of a compliance mechanism 27.

In a machine in which a dresser holding rotary section is neither stretched nor shrunken, which is different from the above-mentioned example, that is, in a machine wherein the height of a dresser is varied by up-and-down movement of a supporting pole 8, a displacement sensor may be fitted to the supporting pole 8 to measure the displacement of the upper portion of the supporting pole and that of the lower portion thereof with respect to the fitted sensor position.

Figure 4:
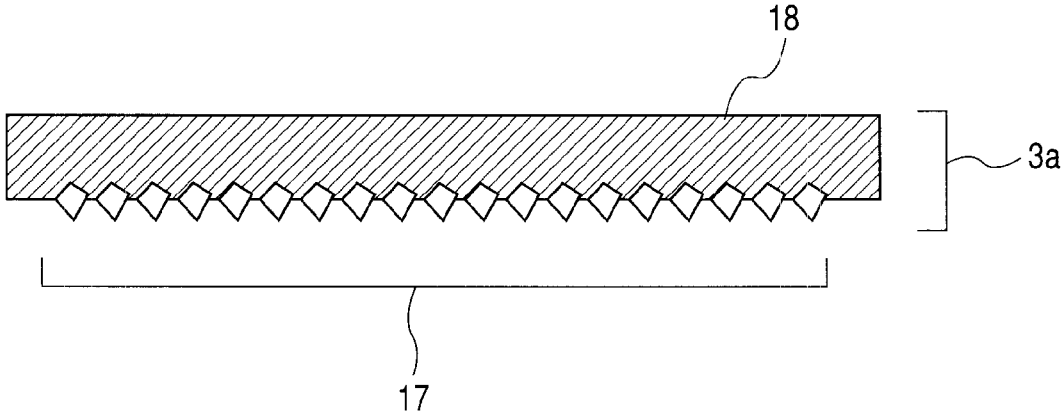
FIG. 4 is a sectional view of a dresser in the CMP machine used in the semiconductor integrated circuit device manufacturing method of the embodiment of the invention.

FIG. 4 is a schematic sectional view of the dresser 3*a*. The dresser 3*a* is generally formed by fixing diamond grains 17, which may be placed into other dressing grains, onto a metallic disc 18 made of nickel, titanium or the like by electroplating.

Figure 5:
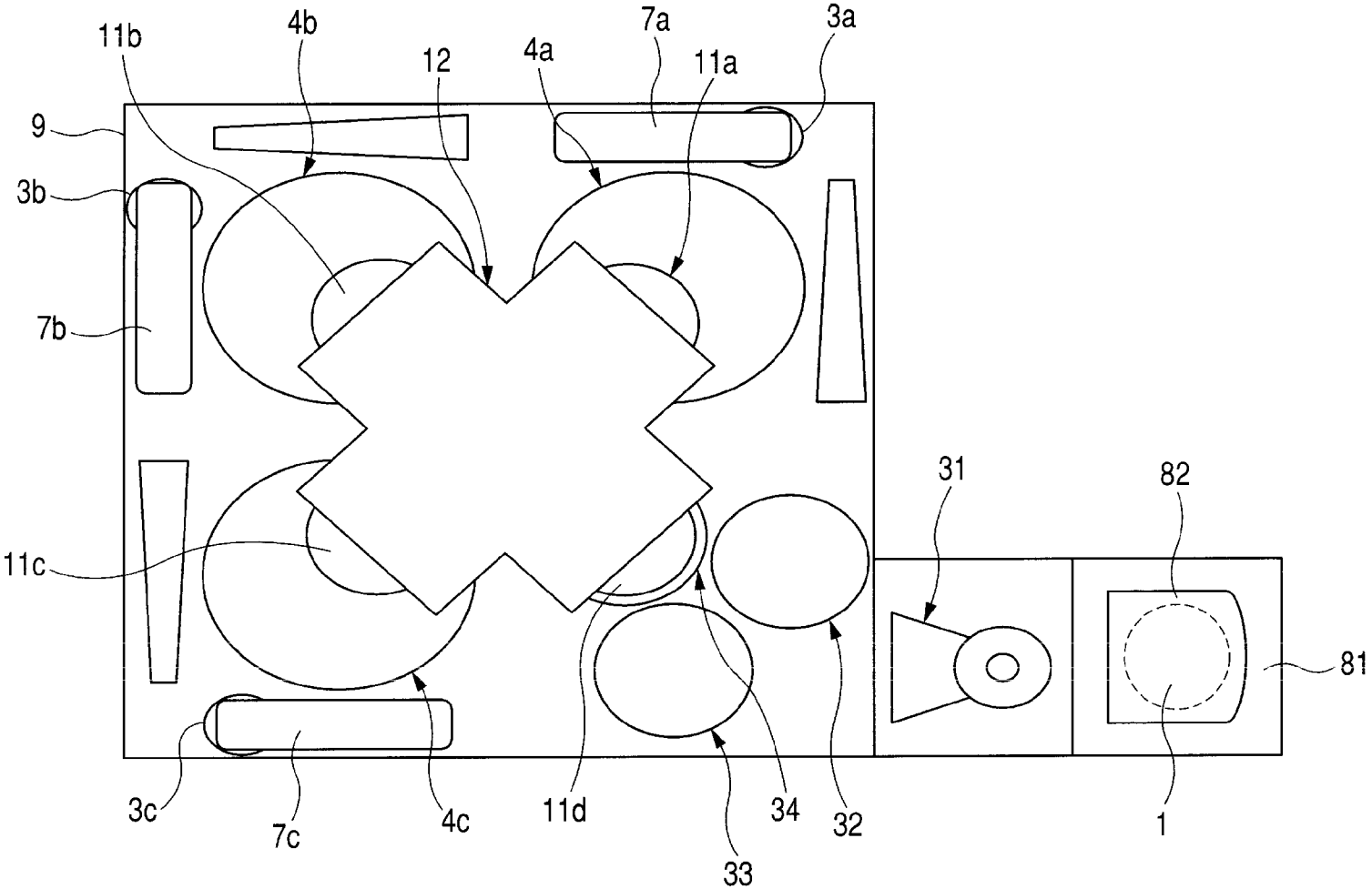
FIG. 5 is a top view of the whole of the CMP machine used in the semiconductor integrated circuit device manufacturing method of the embodiment of the invention.

FIG. 5 is a top view of the whole of the CMP machine. This machine has a second platen 4*b* and a third platen 4*c* besides the first platen 4*a*, and the wafer 1 inside a hoop (semiconductor wafer sealing container) 82 on a load port 81 is received in an input station 32 by a handling robot 31 in a state that a first main surface of the wafer 1 is faced downwards, and the wafer 1 is placed in position by means of a load cup 34 and is adsorbed onto each of polishing heads 11*a*, 11*b*, 11*c* and 11*d*. In a state that the wafer 1 is held by the polishing head, the wafer 1 is successively rotated around the three platens 4*a*, 4*b* and 4*c* by means of the autorotating/revolving mechanism 12, so as to be subjected to polishing treatment. Finally, the wafer 1 is shifted to an output station 33 via the load cup 34. Therefrom, the wafer 1 is returned to the hoop 82 by the handling robot 31. The platens are equipped with dresser mechanisms (or polishing pad conditioning mechanism), respectively. The mechanisms are made of dressers 3*a*, 3*b* and 3*c*, arms 7*a*, 7*b* and 7*c*, and others, respectively.

Figure 6:
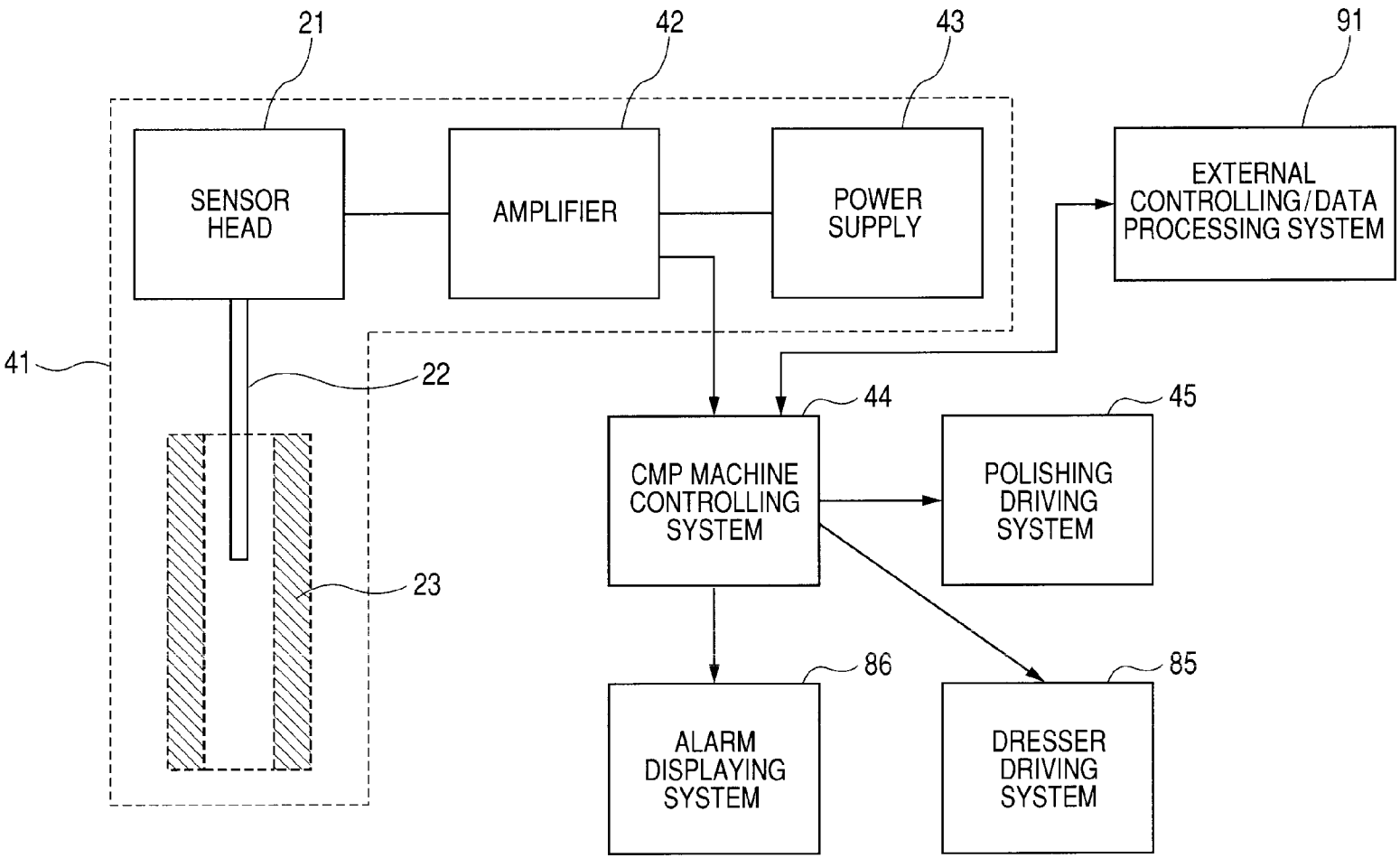
FIG. 6 is a block diagram illustrating an outline of a circuit structure having a system of measuring the perpendicular position of the surface of a polishing pad and a CMP action-controlling/driving system in the CMP machine used in the semiconductor integrated circuit device manufacturing method of the embodiment of the invention.

FIG. 6 is a structural view of a perpendicular position measuring circuit 41, and a controlling/driving system of the CMP machine based on signals from the circuit 41. For example, the sensor head section 21 reads out a change in positional relationship between the displacement body 23, which may be made of a brass pipe, and the sensor rod section (coil) 22, and then a signal corresponding to the read value is sent to an amplifier 42, so as to be subjected to amplifying treatment and other treatments. To these elements is supplied electric power from a power supply circuit 43. The measured result is then outputted to the CMP machine control system 44. On the basis of this signal, the CMP machine control system 44 controls a polishing driving system 45 and a dresser driving system 85 (control action: for example, real-time control of the dressing time and the dressing pressure). Moreover, on the basis of the signal, the CMP machine control system 44 controls an alarm display system 86 to display an alarm (display action: for example, display of the coming of the time when the polishing pad should be exchanged). Furthermore, the system 44 stores various data or sends out the same to the outside (for example, a host control system of a factory or an external data processing system 91) through a communication channel (data log storing action, and other data storing/sending actions: for example, sending of dressing rate data to an external control system).

Figure 7:
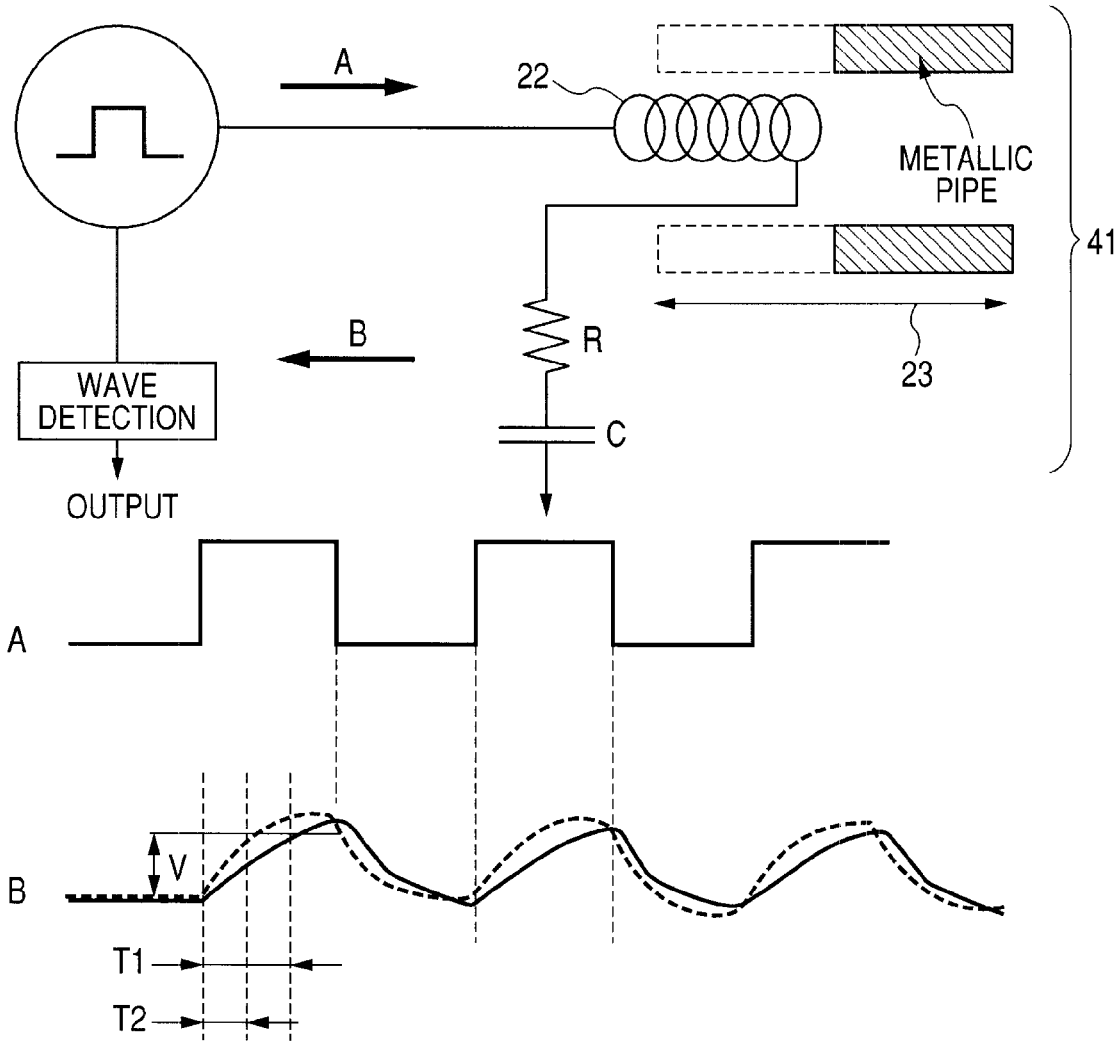
FIG. 7 is an action explanatory view illustrating an outline of circuit action of the system of measuring the perpendicular position of the polishing pad surface in the CMP machine used in the semiconductor integrated circuit device manufacturing method of the embodiment of the invention.

FIG. 7 is a circuit action explanatory view, with reference to which the action of the perpendicular position measuring circuit 41 will be described. When a pulse signal is applied thereto, the waveform B of the voltage, in a condenser C, supplied through a resistance R is smoothed by the inductance of the coil 22. When the metallic pipe 23 is displaced outside the coil, the gradient of the waveform is varied by an effect of eddy current. By detecting times $T_1$ and $T_2$ between which the waveform rises up to a threshold value V, a sensor output is obtained (specifically, the voltage waveform B is detected, thereby giving the output). In this chart, the dotted line represents the waveform when the pipe 23 is inserted, and the solid line represents the waveform when the pipe 23 is pulled out. The period of the pulse signal is set to carry out sampling at 10 times per second.

Figure 8:
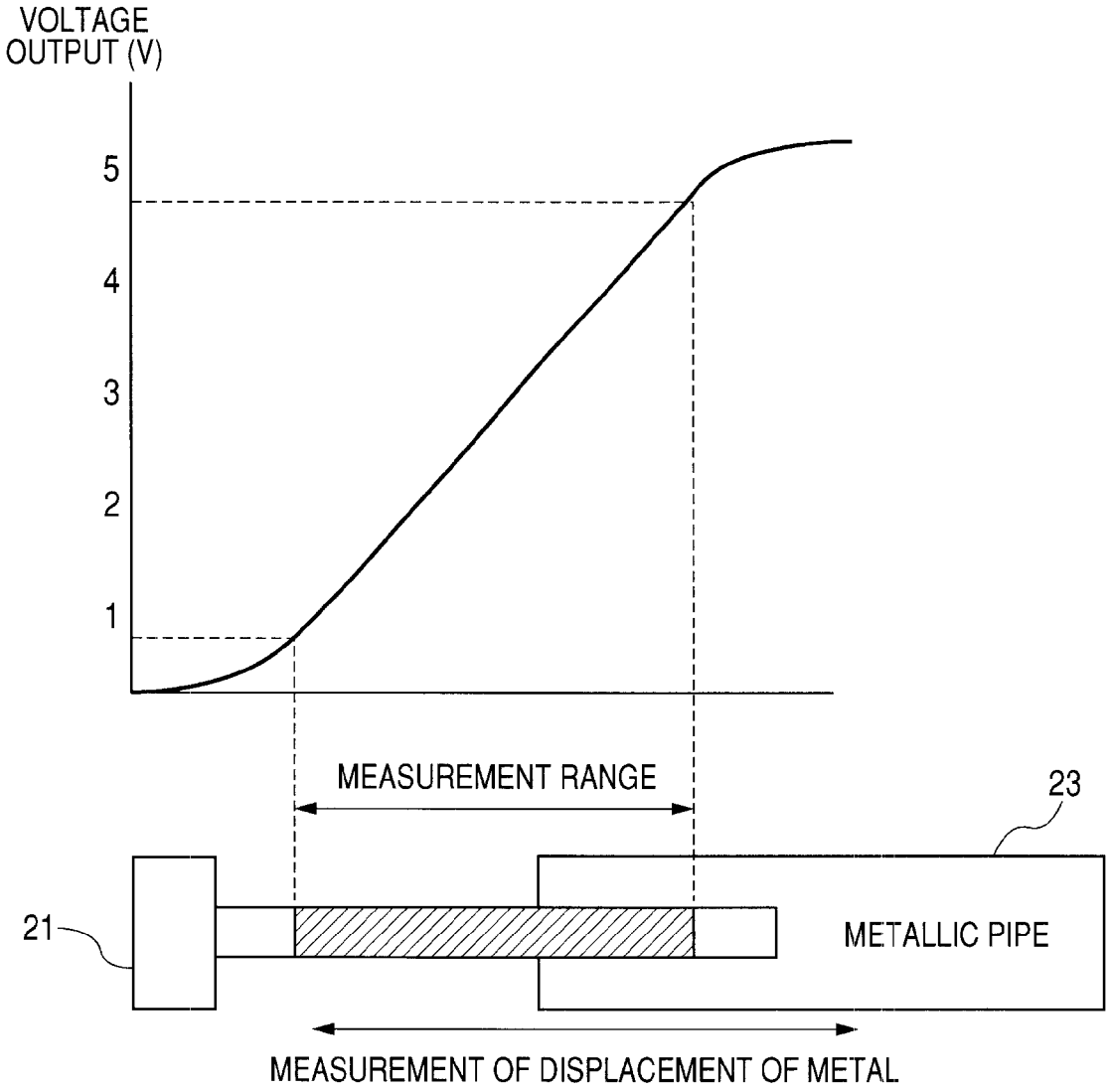
FIG. 8 is an output voltage diagram showing a correspondence between the output of the system of measuring the perpendicular position of the polishing pad surface in the CMP machine used in the semiconductor integrated circuit device manufacturing method of the embodiment of the invention and the positional relationship between a sensor body and a displacement body of a sensor in the CMP machine.

FIG. 8 is an action-explaining chart illustrating the output of the perpendicular position measuring circuit 41 and the positional relationship between the displacement body 23 and the coil 22. It is understood from this chart that as the length by which the coil 22 is covered with the pipe 23 becomes larger, the output becomes smaller.

Figure 9:
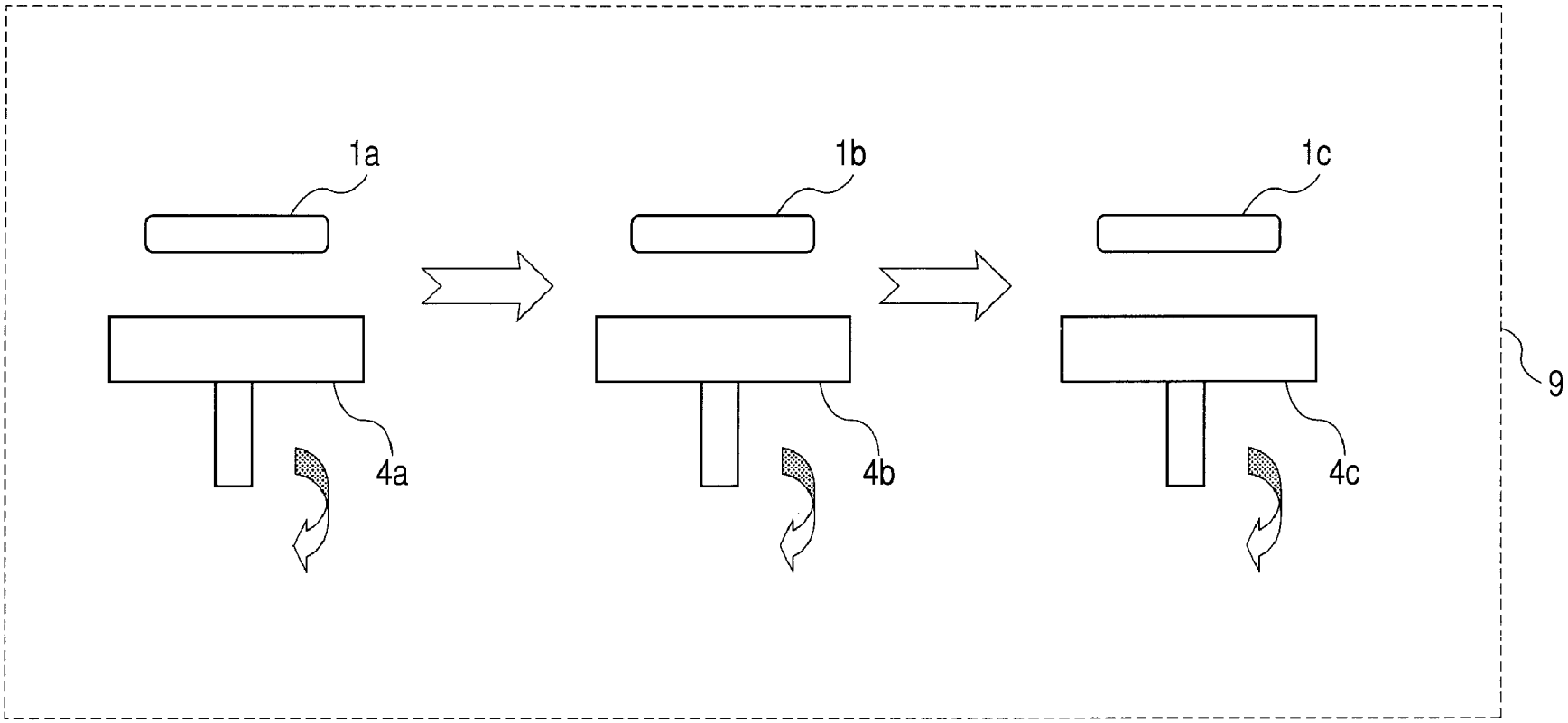
FIG. 9 is a schematic side sectional view showing a processing flow of polishing operation of the CMP machine used in the semiconductor integrated circuit device manufacturing method of the embodiment of the invention.

FIG. 9 is a schematic side sectional view, referring to which a description will be made about the movement of wafers 1*a*, 1*b* and 1*c* to be treated between the platens 4*a*, 4*b* and 4*c* shown in FIG. 5, which has illustrated the whole of the CMP machine. Specifically, the wafer la is positioned on the first platen 4*a*, and is subjected to primary polishing (at this time, the wafer 1*b* is positioned on the second platen, and the wafer 1*c* is positioned on the third platen). Next, the wafer 1*a* is shifted to the second platen, and subjected to secondary polishing (at this time, the wafer 1*b* is positioned on the third platen, and the CMP treatment of the wafer 1*c* is already finished; a new wafer is supplied to the first platen 4*a*; thereafter, a similar matter will be repeated). The wafer 1*a* is then shifted to the third platen, and subjected to the so-called water-polishing (tertiary polishing). That is, the wafer 1*a* is subjected to finish polishing by means of the polishing pads without using any slurry while only pure water or liquid chemical is supplied thereto.

Figure 10:
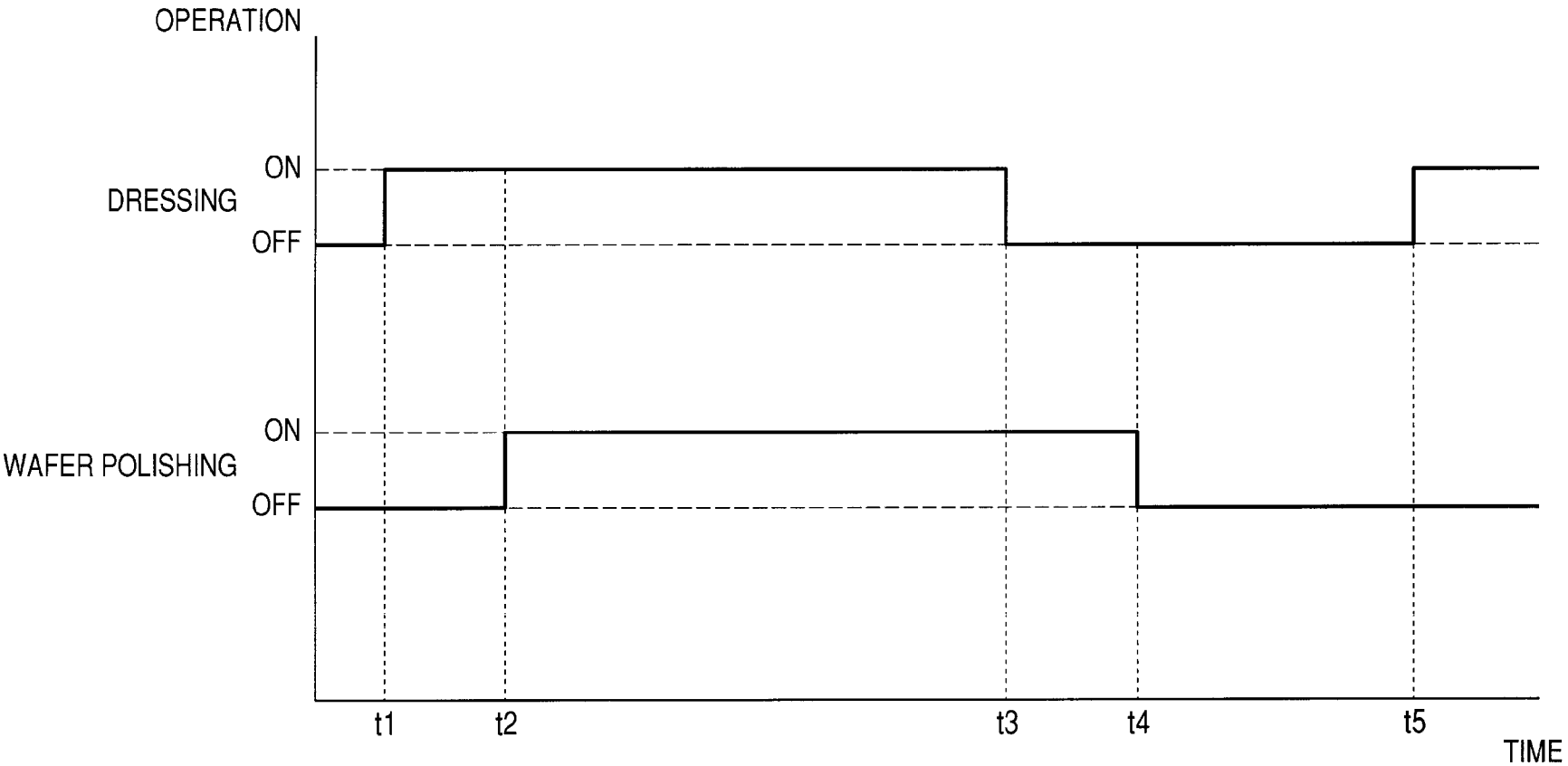
FIG. 10 is a time chart showing a processing sequence in first and second platens in the CMP machine used in the semiconductor integrated circuit device manufacturing method of the embodiment of the invention.

FIG. 10 is a time chart showing a situation of the wafer polishing treatment and the dressing treatment on each of the polishing pads in FIG. 9. On each of the platens, dressing is first started at a time $t_1$ to adjust the state of the pad. Immediately after the adjustment, polishing of the wafer is started at a time $t_2$("dressing precedent time", that is, the period from $t_1$ to $t_2$ is, for example, about 12 seconds). Thereafter, the dressing is early ended at a time $t_3$("dressing/polishing parallel processing time", that is, the period from $t_2$ to $t_3$ is, for example, about 60seconds). Immediately after the time $t_3$, the polishing treatment of the wafer is ended at a time $t_4$("polishing independent processing time", that is, the period from $t_3$ to $t_4$ is, for example, about 3 seconds). Thereafter, the wafer is shifted to the next platen, and dressing of the pad is again started at a time $t_5$ before polishing of a new wafer is started ("non-processing timel", that is, the period from $t_4$ to $t_5$ is, for example, about 15 seconds). The cycle is then repeated. For the tertiary polishing, only water polishing is performed and no dressing is generally performed. Accordingly, in the tertiary polishing, the dressing region in this figure should be ignored. Of course, dressing may be performed therein if necessary. According to the above-mentioned action, the polishing pad thickness is measured in 120 points of the polishing pad (the number of sweeps: about 4, the number of platen rotations: about 12, and the number of dresser rotations: about 8) in the dressing precedent time. If necessary, the dressing precedent time is shortened or extended in real time on the basis of the measurement data (conversely, "polishing time" $t_{2-t4}$ may be shortened or extended) however, the former is advantageous from the viewpoint of the life span of the dresser), so as to make it possible to maintain an appropriate polishing amount and an appropriate polishing property all times. In a case as described above, an appropriate pad state may be maintained by controlling the dressing pressure at each of the points without varying the dressing precedent time or the polishing time (this manner is advantageous from the viewpoint of throughput). By combining these manners, an appropriate polishing state may be maintained. Specifically, processing as described below is provided. First, on the basis of the polishing pad data obtained in the dressing/polishing parallel processing time, a subsequent wafer processing (polishing treatment or dressing treatment) is subjected to feed back correction/control. Second, on the basis of the polishing pad data obtained in the dressing precedent time, polishing treatment of the wafer to be treated in the present step is corrected/controlled in real time. Third, on the basis of the polishing pad data obtained in the first half of the dressing precedent time, in the second half of the dressing precedent time in the present step, the dressing treatment is corrected/controlled in real time. Fourth, on the basis of polishing pad data obtained in treatments of wafers, and log data thereof, subsequent treatment will be corrected through communication with a host system.

Figure 11:
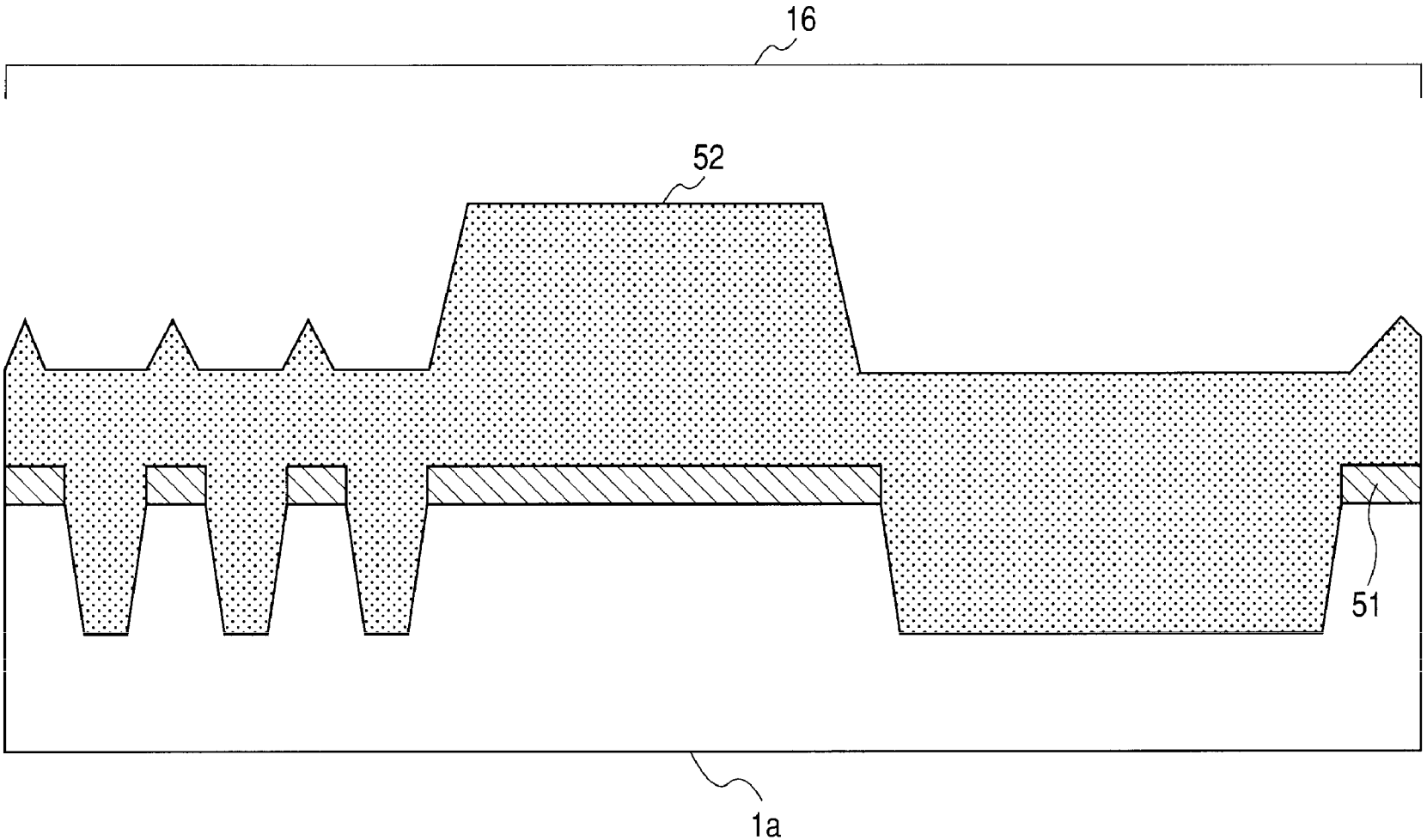
FIG. 11 is a sectional view of a device at an initial stage in a CMP process in the semiconductor integrated circuit device manufacturing method of the embodiment of the invention.
Figure 12:
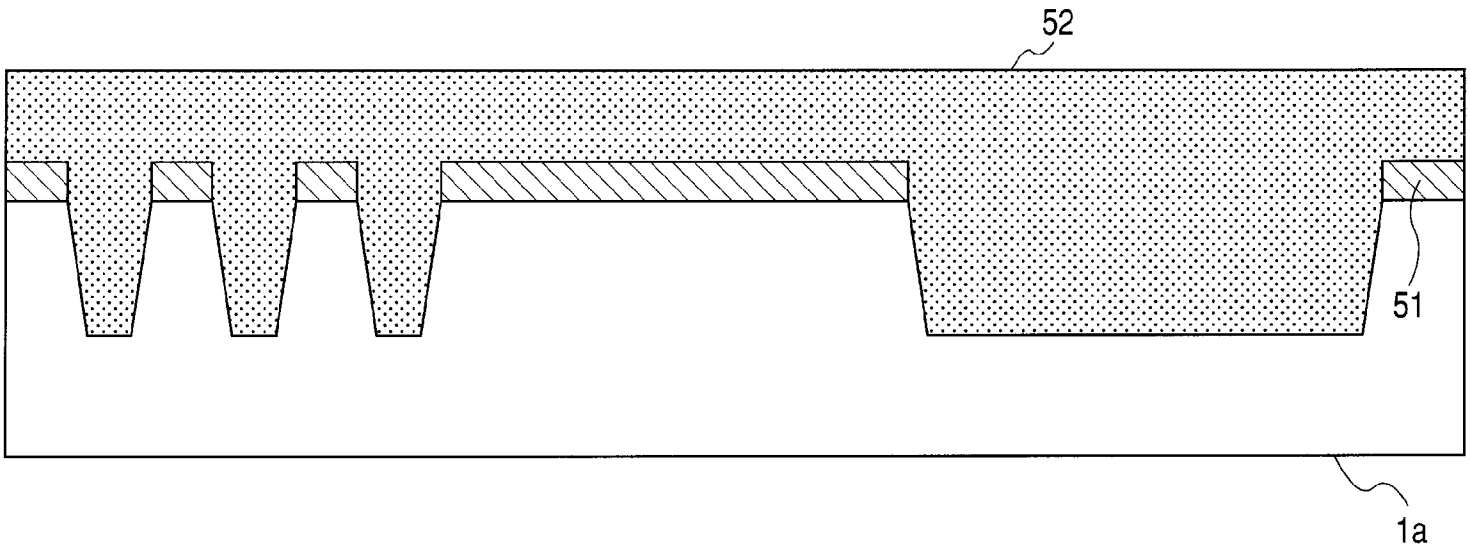
FIG. 12 is a sectional view of the device at a middle stage in the CMP process in the semiconductor integrated circuit device manufacturing method of the embodiment of the invention.
Figure 13:
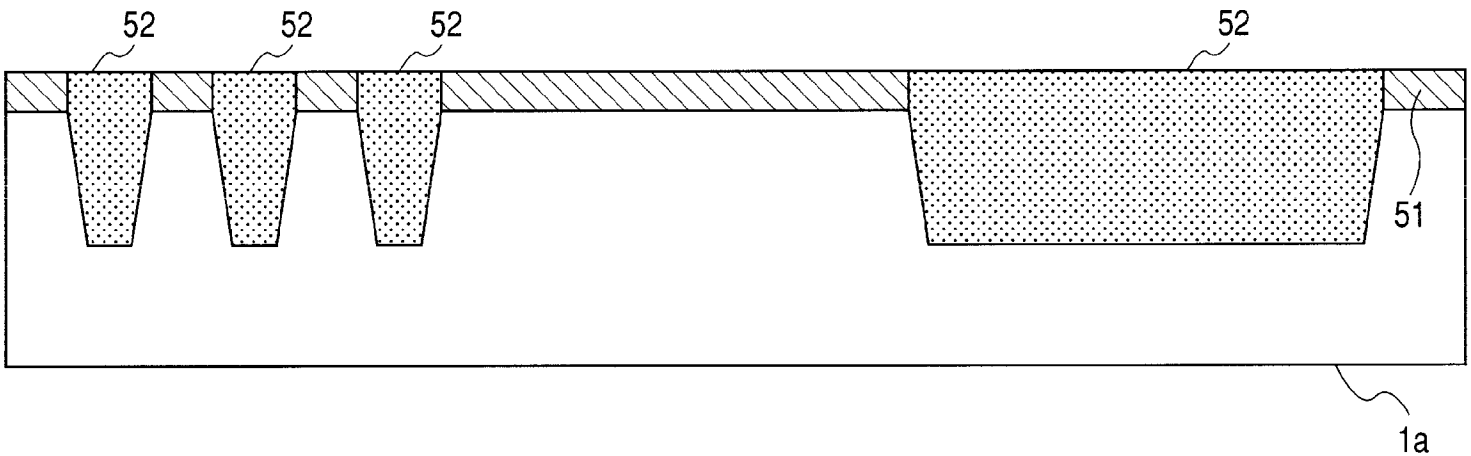
FIG. 13 is a sectional view of the device at a final stage in the CMP process in the semiconductor integrated circuit device manufacturing method of the embodiment of the invention.

FIGS. 11 to 13 are sectiona1 views of the device, which correspond to the treatment steps shown in FIG. 10. FIG. 11 shows a step before the primary polishing. Specifically, FIG. 11 shows a situation that in the first main surface 16 of the wafer 1, a silicon oxide film 52 formed by CVD (chemical vapor deposition) using HDP (high density plasma) is embedded in STI (shallow trench isolation) trenches or the like made in the surface of the substrate (wafer 1*a*). On the surface of the substrate 1*a*, a patterned silicon nitride film 51, which is used as a CMP stopper or the like, is formed. FIG. 12 is a sectional view illustrating a state of the device when the primary polishing is finished, and FIG. 13 is a sectional view illustrating a state of the device when the secondary polishing is finished. Thereafter, the stopper film 51 is selectively removed so that the surface of the substrate 1*a*is exposed. A gate insulated film is formed thereon, and the resultant is shifted to the next step.

Figure 14:
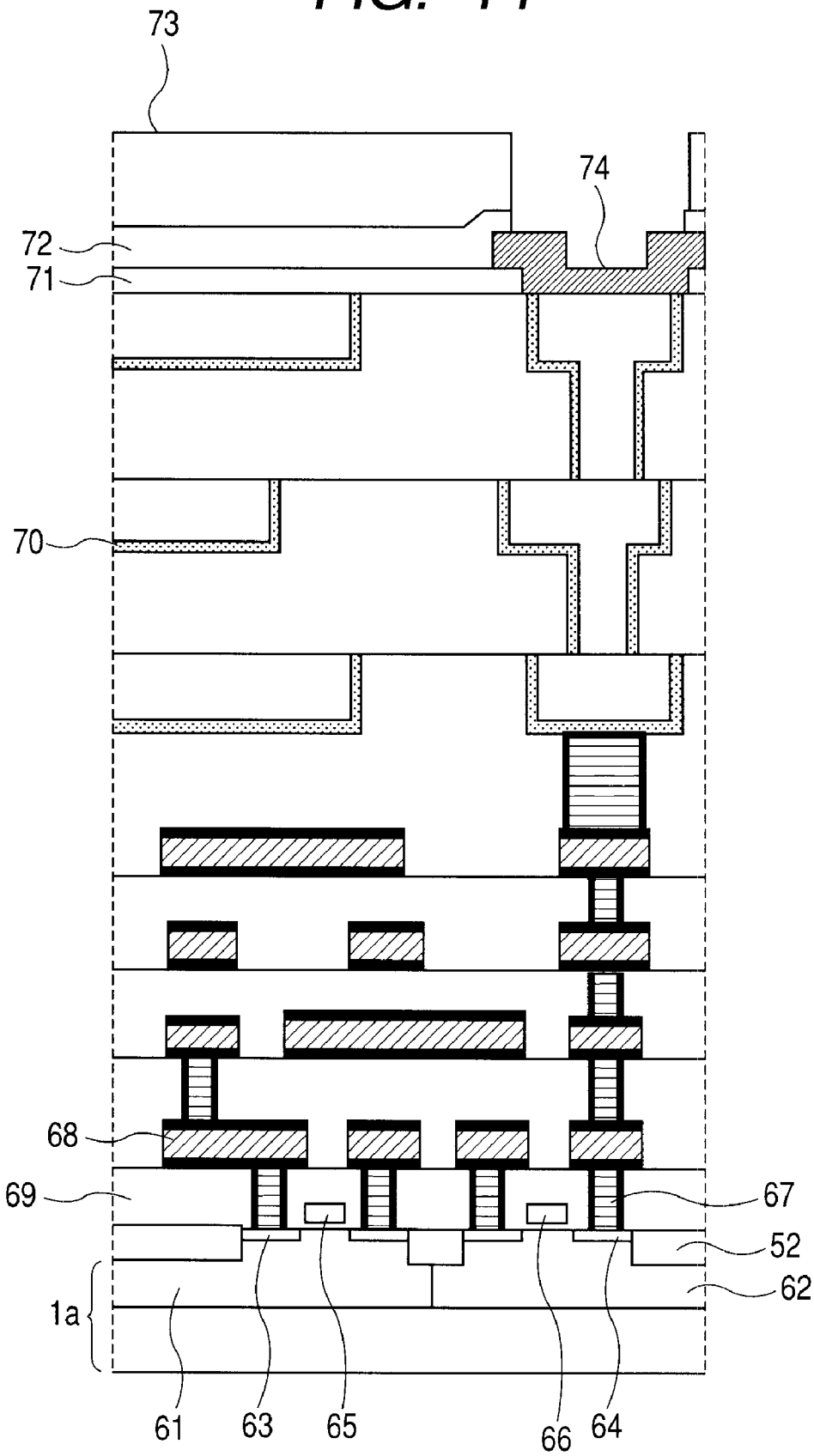
FIG. 14 is a schematic sectional structural view illustrating an ordinary sectional structure of a device obtained by the semiconductor integrated circuit device manufacturing method of the embodiment of the invention.

FIG. 14 illustrates a sectional structure of the device when the process is finished. This device has a wiring structure made of four ordinary aluminum-wiring layers as lower layers, three copper damascene wiring layers as upper layers, and aluminum bonding pads as the topmost layer. In the side of the first main surface of the silicon monocrystal substrate 1*a*(epitaxial substrate), n type wells 61 and p type wells 62 are present, and in each of the wells, a p-type source or drain region 63 and an n type source or drain region 64 are formed. In an upper surface layer of the substrate, gate electrodes 65 of P-type MOS-FETs and gate electrodes 66 of N type MOS-FETs are positioned, and tungsten plugs 67 are embedded in contact holes in a lowermost interlayer dielectric 69. Aluminum wires 68 (wires containing aluminum as a principal component), the upper and lower surfaces of which are sandwiched between barrier metals, are made on the lowermost interlayer dielectric 69. Embedded copper wires 70 are formed in the 5$^{th}$ wiring layer and all the wiring layers thereon. On the 7$^{th}$wiring layer, a cap insulation layer 71 is formed, , and bonding pads 74 are made in opening in the layer 71. In this case, two-layer structure comprised of a lower plasma silicon nitride film 72 and an upper polyimide film 73 forms a final passivation film.

In the processes for manufacturing the device, CMP treatment is applied mainly to: insulated film CMP processes, such as flattening in the step of the above-mentioned STI, and in the formation of the interlayer dielectrics (the interlayer dielectrics and the in-layer dielectrics in the illustrated embodiment) of the ($1^{st}$ to $4^{th}$) aluminum wiring layers using HDP or the like; and metal CMP processes, that is, the following removal after the copper wiring is formed by plating with copper or some other method in the dual damascene wiring moieties (the $5^{th}$ to $7^{th}$ wiring layers): removal of unnecessary portions of the metal. The same metal CMP process is applied also to the contact plugs 67 or tungsten plugs on the aluminum wiring layer. The present invention may be applied to the two cases. When the invention is applied in particular to a CMP process for a silicon oxide film system or a silicon system, wherein polishing pads are intensely worn away, large advantageous effects can be expected. In the invention, measurement is made without using light; therefore, the invention has an advantage that corrosion based on photoelectric effect or the like is not caused in metal CMP of copper damascene wiring.

According to the above-mentioned embodiment, the state of any one of the polishing pads can be measured through the dresser which contacts the pad directly; therefore, the time for the exchange of the pad, the state of the dresser, or the like can be precisely determined in real time. The type of the dresser and the dressing rate based on the dressing pressure can be measured and stored in real time; therefore, the dressing period can easily be made appropriate. The relationship between the abrasion amount of the polishing pads and the dressing time or the like can be determined continuously; therefore, the generation of a treatment abnormality can be found at an early stage from the data. A desired measurement can be made in real time with a relatively simple sensor; therefore, the machine for the invention can be made having an inexpensive structure.

The above has described the invention made by the inventors specifically about CMP processes using disc-form polishing pads on the basis of the embodiments thereof. However, the invention is not limited thereto. Various modifications may be carried out in a scope which does not depart from the subject matter of the invention.

The invention can be applied to, for example, a CMP process using a single disc-form polishing pad, or a CMP process using a belt-form polishing pad.

What is claimed is:

1. A manufacturing method of a semiconductor integrated circuit device, comprising the steps of:

(a) forming a first member layer over a first main surface of a wafer; and (b) applying chemical mechanical polishing to the first member layer in a chemical mechanical polishing machine, wherein the step (b) comprises the substeps of (i) pressing a rotating dresser to a polishing pad, thereby carrying out dressing treatment;

(ii) supplying a polishing slurry to the polishing pad while moving the pad and the wafer relatively in a state that the first main surface of the wafer is pressed to the polishing pad; and (iii) measuring the position of the dresser in the direction perpendicular to a surface of the polishing pad in the substep (i), thereby detecting an abrasion amount and the thickness of the polishing pad indirectly, and wherein the perpendicular position is measured through a displacement sensor comprising a sensor body having a coil section and a displacement body.

2. The manufacturing method of a semiconductor integrated circuit device according to claim 1, wherein at least one portion of a first time period when the substep (i) is performed and at least one portion of a second time period when the substep (ii) is performed overlap with each other.

3. The manufacturing method of a semiconductor integrated circuit device according to claim 2, wherein the first member layer is an insulation layer.

4. The manufacturing method of a semiconductor integrated circuit device according to claim 3, wherein the first member layer comprises a silicon oxide film as a principal constituent film.

5. The manufacturing method of a semiconductor integrated circuit device according to claim 4, wherein during the first time period when the substep (i) is performed and the second time period when the substep (ii) is performed, main portions of the first and second time periods overlap with each other.

6. The manufacturing method of a semiconductor integrated circuit device according to claim 5, wherein the perpendicular position is measured without bringing a sensor into direct contact with the polishing pad.

7. The manufacturing method of a semiconductor integrated circuit device according to claim 6, wherein the perpendicular position is measured without using light.

8. The manufacturing method of a semiconductor integrated circuit device according to claim 7, wherein the polishing pad is rotating in the substeps (i) and (ii).

9. The manufacturing method of a semiconductor integrated circuit device according to claim 8, wherein the wafer is rotating in the substep (ii)

10. The manufacturing method of a semiconductor integrated circuit device according to claim 9, wherein the position of the dresser in the direction of a radius of the polishing pad is varied over the polishing pad in the substep (i).

11. The manufacturing method of a semiconductor integrated circuit device according to claim 10, wherein the perpendicular position is measured plural times in the first term when the substep (i) is performed.

12. The manufacturing method of a semiconductor integrated circuit device according to claim 1, wherein the dresser is fixed to a dresser holding rotary section, the dresser holding rotary section can be controlled to be stretched and shrunken up and down, the rotary section itself is rotatably held by a dresser head section, the dresser head section is held by a dresser supporting section through a dresser arm, and the dresser supporting section is held by a base of the chemical mechanical polishing machine so as to be optionally rotated about an axis of the dresser supporting section.

13. The manufacturing method of a semiconductor integrated circuit device according to claim 12, wherein the sensor body is fitted to the dresser head section, which holds the dresser.

14. The manufacturing method of a semiconductor integrated circuit device according to claim 13, wherein the displacement body is fixed to the dresser holding rotary section.

15. The manufacturing method of a semiconductor integrated circuit device according to claim 14, wherein the displacement sensor is a sensor for measuring, electrically, a change in the impedance of the coil section in the displacement sensor on the basis of a displacement of an object to be measured.

16. A manufacturing method of a semiconductor integrated circuit device, comprising the steps of:

(a) forming a first member layer over a first main surface of a wafer; and (b) applying chemical mechanical polishing to the first member layer in a chemical mechanical polishing machine, wherein the step (b) comprises the substeps of (i) pressing a rotating dresser to a polishing pad, thereby carrying out dressing treatment;

(ii) supplying a polishing slurry to the polishing pad while moving the pad and the wafer relatively in a state that the first main surface of the wafer is pressed to the polishing pad; and (iii) measuring the position of the dresser in the direction perpendicular to the surface of the polishing pad in the substep (i), thereby detecting the abrasion amount and the thickness of the polishing pad indirectly, wherein the dresser is fixed to a dresser holding rotary section, wherein the dresser holding rotary section is rotatably held by a dresser head section, wherein the dresser head section is held by a dresser supporting section through a dresser arm, and wherein the dresser supporting section is held by a base of the chemical mechanical polishing machine so as to be optionally moved up and down and rotated about an axis of the dresser supporting section, and wherein the perpendicular position is measured through a displacement sensor comprising a sensor body comprising a coil section, and a displacement body.

17. The manufacturing method of a semiconductor integrated circuit device according to claim 16, wherein the displacement sensor is fitted to the dresser supporting section.

18. The manufacturing method of a semiconductor integrated circuit device according to claim 17, wherein the perpendicular position is measured by measuring the up-and-down motion of the dresser supporting section through the displacement sensor.

* * * * *